US008742688B2

(12) United States Patent
Lee et al.

(10) Patent No.: US 8,742,688 B2
(45) Date of Patent: Jun. 3, 2014

(54) HARBOR LIGHTING CONTROL APPARATUS

(75) Inventors: Dong Won Lee, Yongin-si (KR); Chang Soo Lim, Seoul (KR); Tae Eung Kim, Gyunggi-do (KR); Sang Kyeong Yun, Gyunggi-do (KR); Yong Min Jung, Gyunggi-do (KR); Tae Keun Oh, Suwon Gyunggi-do (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 103 days.

(21) Appl. No.: 13/505,179

(22) PCT Filed: Oct. 29, 2010

(86) PCT No.: PCT/KR2010/007531

§ 371 (c)(1),
(2), (4) Date: Jul. 16, 2012

(87) PCT Pub. No.: WO2011/053047

PCT Pub. Date: May 5, 2011

(65) Prior Publication Data

US 2012/0274236 A1 Nov. 1, 2012

(30) Foreign Application Priority Data

Oct. 30, 2009 (KR) ..... 10-2009-0104565

(51) Int. Cl.
*H05B 37/02* (2006.01)

(52) U.S. Cl.
USPC ..... 315/297; 315/294; 315/307

(58) Field of Classification Search
USPC ..... 315/297, 294, 307, 313, 314, 315
See application file for complete search history.

(56) References Cited

U.S. PATENT DOCUMENTS

2009/0284184 A1* 11/2009 Valois et al. ..... 315/312

FOREIGN PATENT DOCUMENTS

| | | | |
|---|---|---|---|
| KR | 10-0267057 | B1 | 6/2000 |
| KR | 10-2003-0090374 | A | 11/2003 |
| KR | 10-2006-0010996 | A | 2/2006 |
| KR | 10-2007-0053468 | A | 5/2007 |

* cited by examiner

*Primary Examiner* — Daniel D Chang
(74) *Attorney, Agent, or Firm* — McDermott Will & Emery LLP

(57) ABSTRACT

A harbor lighting control apparatus is provided, which includes a plurality of slaves to perform on control or off control, and dimming control with respect to a light emitting diode (LED) array light source mounted to a lighthouse when an on control signal or off control signal, and a dimming control signal are received, and to transmit a result of the control as acknowledge signals, and a master to transmit the on control signal or off control signal and the dimming control signal to all of the plurality of slaves by a broadcast scheme, to transmit the on control signal or off control signal and the dimming control signal to an individual slave by a unicast scheme, and to recognize operational states of the plurality of slaves by receiving the acknowledge signals from the plurality of slaves. Accordingly, stable and reliably control of the harbor lighting is enabled.

8 Claims, 7 Drawing Sheets

HARBOR LIGHTING CONTROL APPARATUS

TECHNICAL FIELD

The present invention relates to a harbor light control apparatus.

BACKGROUND ART

A light emitting diode (LED) is capable of expressing almost all colors of nature using red, green, blue (RGB) lights. Furthermore, since the LED is environment-friendly, power saving, and semi-permanent, the LED is being widely used for lighting implementing various colors.

Conventionally, a digital multiplex (DMX) control method is generally used as an LED lighting control method.

The DMX, abbreviated from DMX512, transmits data of 250,000 bits (250 kbps) per second, using RS-485 that enables communication with two wires, and provides 512 channels per data link.

According to a conventional LED lighting device, a DMX controller generating a DMX control signal and a plurality of LED lighting devices are interconnected by the Daisy chain method.

The DMX controller transmits 512 consecutive packets to the LED lighting device. Here, according to DMX communication standard, one packet includes 1 bit as a start bit, 8 bits as data bits, and 2 bits as stop bits.

The LED lighting devices each have a unique address and thereby receive a data code of a corresponding packet and control lighting using the data code.

Since DMX data includes 8 bits, brightness of an LED may be adjusted by totally 256 (from 0 to 256) levels. When an RGB LED is used, totally 16,777,215 (2563-1) colors may be implemented.

However, the conventional LED lighting control method is insufficient for a harbor LED lighting device which requires high reliability, high stability, and high output.

DISCLOSURE OF INVENTION

Technical Goals

An aspect of the present invention provides a harbor lighting control apparatus having a bi-directional communication function.

Technical Solutions

According to an aspect of the present invention, there is provided a harbor lighting control apparatus including a plurality of slaves to perform on control or off control, and dimming control with respect to a light emitting diode (LED) array light source mounted to a lighthouse when an on control signal or off control signal, and a dimming control signal are received, and to transmit a result of the control as acknowledge signals, and a master to transmit the on control signal or off control signal and the dimming control signal to all of the plurality of slaves by a broadcast scheme, to transmit the on control signal or off control signal and the dimming control signal to an individual slave by a unicast scheme, and to recognize operational states of the plurality of slaves by receiving the acknowledge signals from the plurality of slaves.

Each of the plurality of slaves may include a slave receiving unit to receive the on control signal or off control signal and the dimming control signal from the master; a slave transmission unit to transmit the acknowledge signals in relation to the on control signal or off control signal and the dimming control signal to the master; an LED drive to perform the on control or off control and the dimming control with respect to the LED array light source; and a control unit to control the LED drive to perform the on control or off control and the dimming control with respect to the LED array light source when the on control signal or off control signal and the dimming control signal are received from the master, and to transmit a result of the control as a acknowledge signal to the master through the slave transmission unit.

The master may include a key input unit to receive an input of a command through key operation by a user; a master transmission unit to transmit the on control signal or off control signal and the dimming control signal to all of the plurality of slaves by the broadcast scheme or the unicast scheme; a master receiving unit to receive the acknowledge signals transmitted from the plurality of slaves; and a control unit to transmit the on control signal or off control signal and the dimming control signal by the broadcast scheme through the master transmission unit when an on request signal or off request signal and a dimming request signal with respect to all of the plurality of slaves are input through the key input unit, to transmit the on control signal or off control signal and the dimming control signal through the master transmission unit by the unicast scheme when the on request signal or off request signal and the dimming request signal are related to the individual slave, and to recognize operational states of the plurality of slaves by receiving the acknowledge signals from the plurality of slaves through the master receiving unit.

The master may transmit state request signals to the plurality of slaves to request an on state, an off state, and a breakdown state of the LED array light source, and the plurality of slaves may recognize a state of the LED light source and transmit the state as a response signal when the state request signals are received from the master.

Formats of the signals transmitted between the master and the plurality of slaves may include a start field, a type field, an address field, a data field, a checksum field, and an end field.

Terms or words used in the specification and claims herein should be not construed as a general and lexical meaning and should be construed as the meaning and concept meeting the technical idea of the present invention based on a principle that the present inventors can properly define the concepts of terms in order to elucidate their own invention in the best method.

BEST MODE FOR CARRYING OUT THE INVENTION

Figure 1:
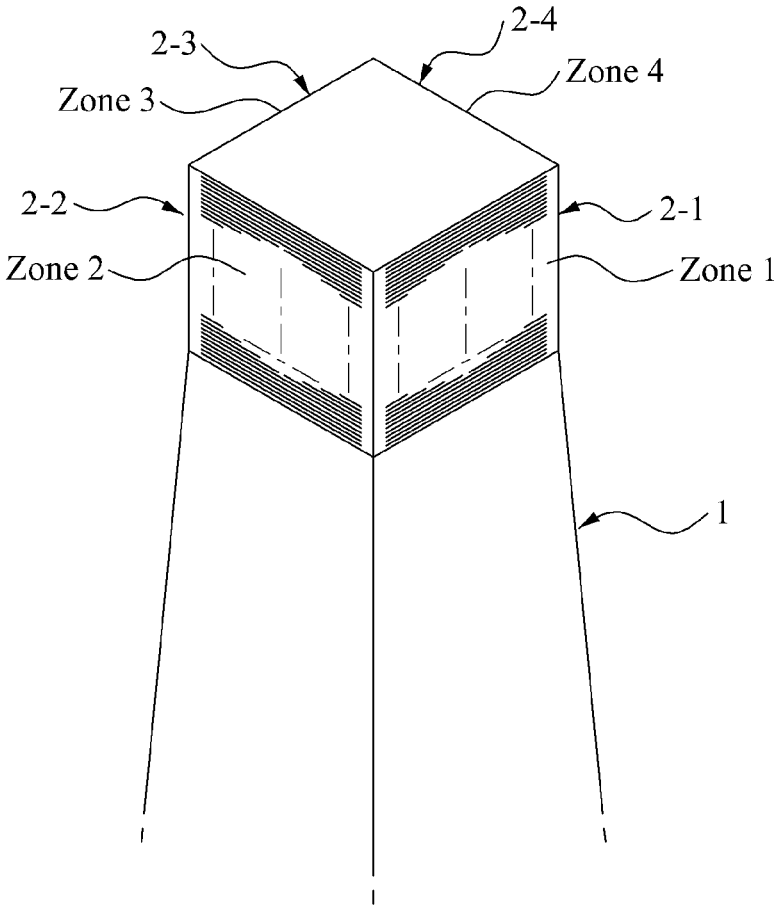
FIG. 1 is a view illustrating an appearance of a harbor lighting control apparatus according to an embodiment of the present invention.

Aspects, particular advantages, and features of the present invention will be clarified through the detailed description and exemplary embodiments with reference to the accompanying drawings. In particular, the present invention is well pointed out and clearly claimed in claims. In the drawings, like reference numerals refer to like elements throughout. In addition, if detailed descriptions of related disclosed art or configuration are determined to unnecessarily make the subject matter of the present invention obscure, they will be omitted.

Reference will now be made in detail to embodiments of the present invention, examples of which are illustrated in the accompanying drawings.

FIG. 1 is a view illustrating an appearance of a harbor lighting control apparatus according to an embodiment of the present invention.

Referring to FIG. 1, a lighthouse 1 mounted with the harbor lighting control apparatus may include a light emitting diode (LED) array panels 2-1 to 2-4 attached to every sidewall of a rectangular upper part, so that lighting is performed in 4 directions. However, an upper surface of the lighthouse 1 may be provided in a polygonal shape and an LED array panel may be mounted to every sidewall, so that lighting is performed in various directions.

Here, the respective LED array panels 2-1 to 2-4 may be divided into four separate zones, that is, Zone 1 to Zone 4 to efficiently control the lighting operation.

Figure 2:
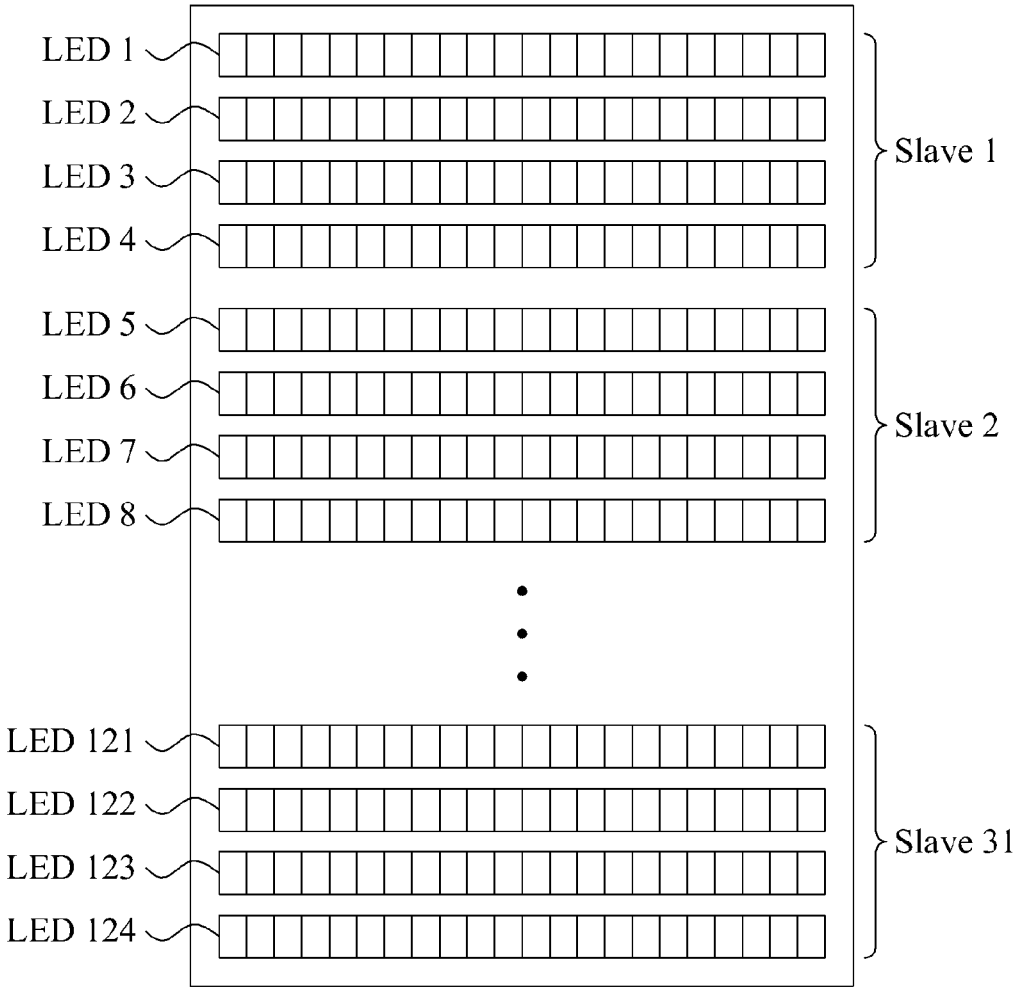
FIG. 2 is a detailed view illustrating a light emitting diode (LED) array light source panel shown in FIG. 1.

Referring to FIG. 2 enlarging the LED array panels 2-1 to 2-4, the LED array panels 2-1 to 2-4 may include 124 LED array light sources, that is, LED1 to LED124. Assuming that every four array light sources are controlled by one slave, the 124 LED array light sources, LED1 to LED124, may be controlled using 31 slaves, that is, Slave 1 to Slave 31.

Figure 3:
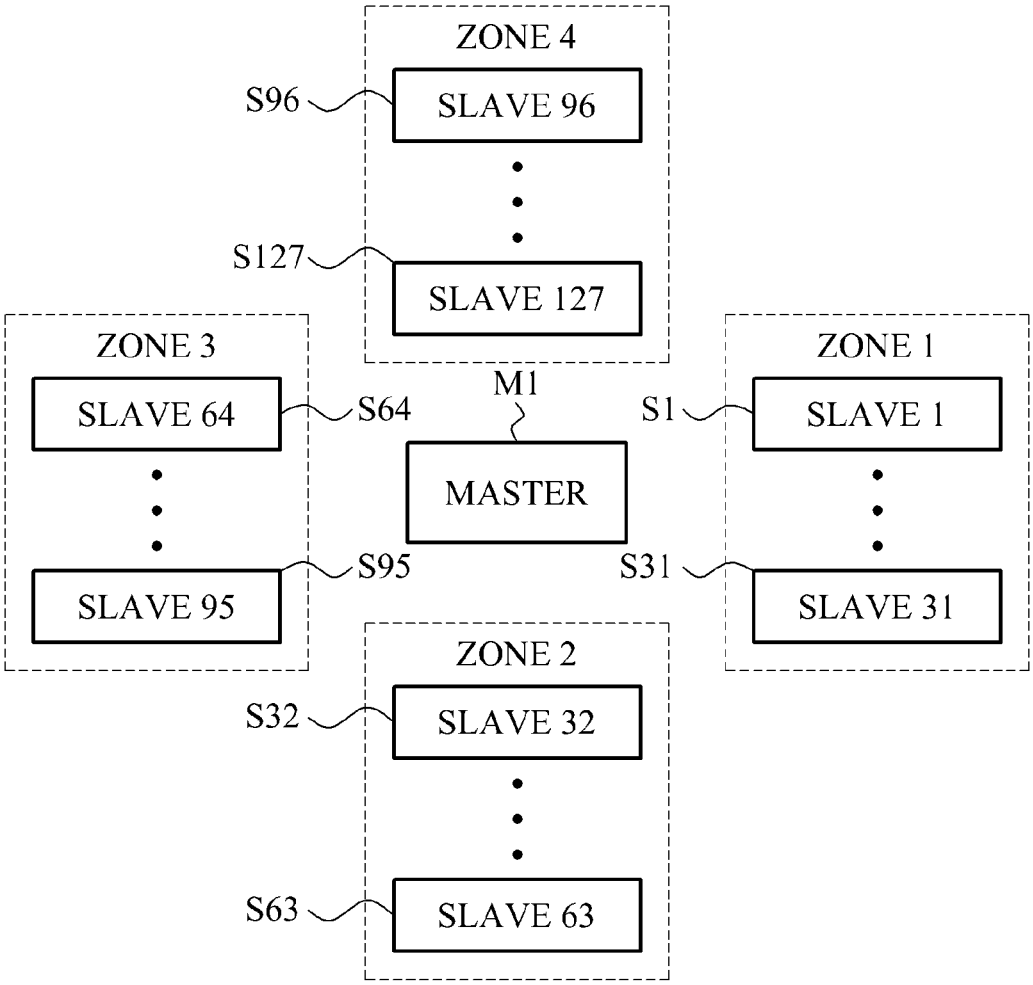
FIG. 3 is a structure view of a harbor lighting control apparatus according to an embodiment of the present invention.

FIG. 3 is a structure view of a harbor lighting control apparatus according to an embodiment of the present invention.

As shown in the drawing, the harbor lighting control apparatus may include a master M1 and a plurality of slaves, for example, slaves S1 to S127 surrounding the master M1. The master M1 and the slaves S1 to S127 may communicate using a near field communication (NFC) method such as zigbee communication.

Here, the slaves S1 to S127 may be divided into four zones, such that slaves S1 to S31 constitute Zone 1, slaves S32 to S63 constitute Zone 2, slaves S64 to S95 constitute Zone 3, and slaves S96 to S127 constitute Zone 4.

The master M1 may transmit command data packets (CMDs) to all the slaves S1 to S127 by a broadcast scheme, thereby controlling all the slaves S1 to S127 to turn on or off the corresponding LED array light sources or to perform dimming by which the LED array light sources are gradually lightened or darkened.

In addition, the master M1 may transmit the CMDs separately to an individual of the slaves S1 to S127 by a unicast scheme, thereby controlling a corresponding one of the slaves S1 to S127 to turn on or off or to perform dimming with respect to a corresponding LED array light source.

Also, the master M1 may transmit a request data packet Req separately to an individual of the slaves S1 to S127 by the unicast scheme, so that a corresponding one of the slaves S1 to S127 reports an on or off state of a corresponding LED array light source, or a level of dimming when dimming is performed. Additionally, whether a fan is in normal operation may be reported.

When the slaves S1 to S127 receives a CMD from the master M1 by the broadcast scheme or the unicast scheme, the CMD requesting to turn on or off or to perform diming with respect to a corresponding LED array light source, the slaves S1 to S127 may control the corresponding LED array light source and inform the master M1 of a control result through an acknowledge data packet Ack.

In addition, when receiving a data packet from the master M1 by the unicast scheme, the data packet requesting to inform whether the LED array light source is in an on state, an off state, or a breakdown state or inform whether the fan is in normal operation, the slaves S1 to S127 may recognize the states of the LED array light source and the fan and inform the master M1 of a recognition result through a response data packet Rep.

Figure 4:
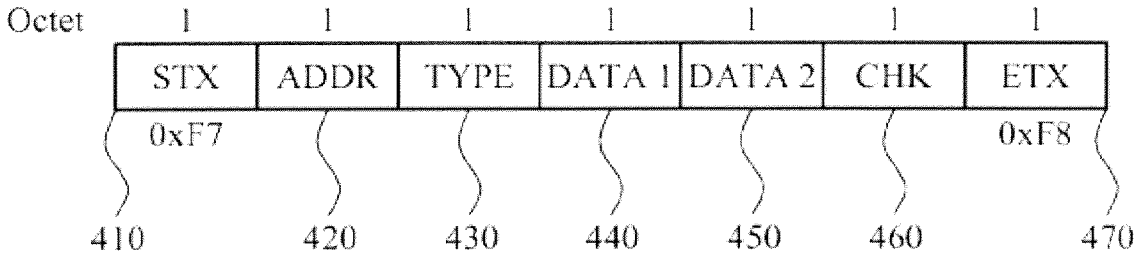
FIG. 4 is a view illustrating a format of a data packet used by a harbor lighting control apparatus according to an embodiment of the present invention.

FIG. 4 shows formats of the data packets used by the harbor lighting control apparatus. The data packets may include total seven fields, that is, a start field 410, an address field 420, a type field 430, data fields 440 and 450, a checksum field 460, and an end field 470. Each field is allocated with 1 byte.

The start field 410 indicates start of a new data packet by designating 1 byte of a particular number.

Figure 5:
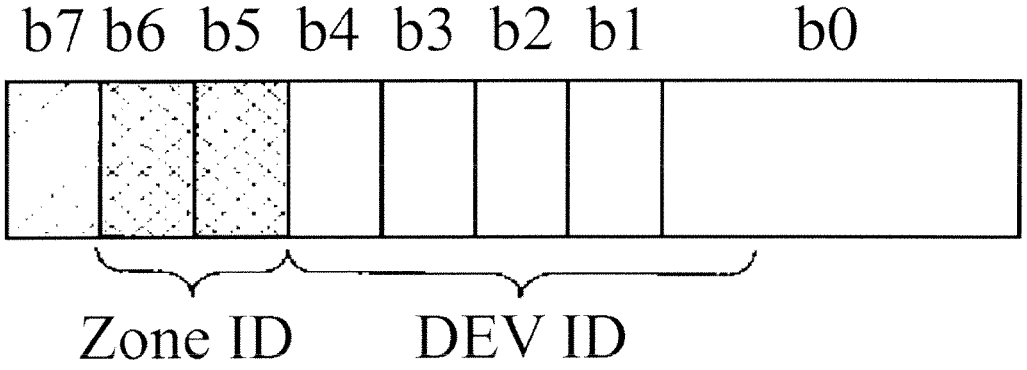
FIG. 5 is a detailed structure view illustrating an address field of FIG. 4.

As shown in FIG. 5, the address field 420 allocates a most significant bit (MSB) of the 1 byte as an identifier (ID) for distinguishing between the broadcast scheme and the unicast scheme. When 1 is designated, the ID indicates a broadcast data packet. When 0 is designated, the ID indicates a unicast data packet.

Out of the 1 byte of the address field 420, two bits, that is, a second significant and a third significant bit, are allocated to an ID for distinguishing zones, that is, Zone ID. For example, when 00 is designated, the ID indicates Zone 1. When 01 is designated, the ID indicates Zone 1. When 10 is designated, the ID indicates Zone 3. When 11 is designated, the ID indicates Zone 4.

Besides, remaining bits of the address field 420 may be allocated with a slave ID for identifying slaves, that is, Dev ID.

When the address field 420 is a data packet transmitted from a master to a slave, a destination address may be allocated. When the address field 420 is a data packet transmitted from the slave to the master, a source address may be allocated.

The type field 430 refers to a field for identifying whether a data type of the data packet being transmitted is a command message, a request message, a response message, or an acknowledge message. The master or the slave may recognize the data type by checking a value designated to a corresponding field.

The data fields 440 and 450 refer to fields for transmitting an available command, state information, completion of operation, failure of operation, or the like according to the respective data type. The master may perform on control, off control, or dimming control with respect to the slave using the data fields 440 and 450. The slave may transmit the state information or inform the completion of operation or the failure of operation using the data fields 440 and 450.

Next, the checksum field 460 enables error inspection of the data packet. The master or the slave may check the checksum field and request retransmission when a data error is generated.

The end field 470 indicates end of the data packet. Through the end field 470, the master or the slave may prepare for reception of a following data packet.

Table 1 below shows an example of the type field and the data field used when the slave transmits data to the master, based on the above description.

TABLE 1

| Type field | | Data field 1 | Data field 2 | Note |
|---|---|---|---|---|
| Response (state response) | 0*01 | 0*0Z | 0*XY | When LED array light source is in on state, X is set to 1 and transmitted. When LED array light source is in breakdown state, Y is set to 1 and transmitted. When fan is in breakdown state, Z is set to 1 and transmitted. |
| Acknowledge | 0*10 | 0*00 | 0*00 | When on operation is completed in response to on control signal, data field 2 is set to 0*00 and transmitted. |
| | 0*11 | 0*00 | 0*00 | When off operation is completed in response to off control signal, data field 2 is set to 0*00 and transmitted. |
| | 0*12 | 0*00 | 0~0*FF | Respond to dimming level (0 means off and 256 means maxium.) |

The master and the slave need a communication module for data transmission using the data packet. Structure for this is illustrated in detail in FIGS. 6 and 7.

Figure 6:
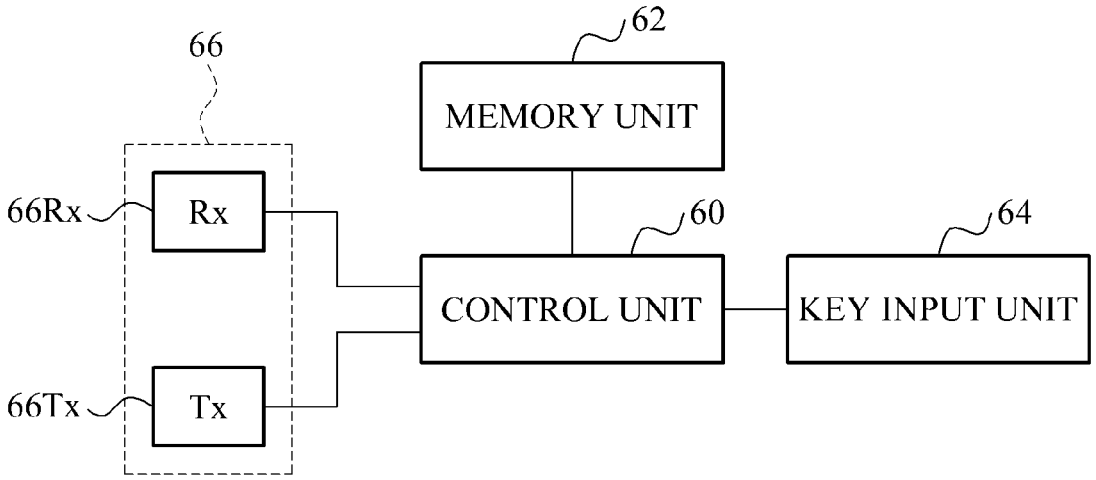
FIG. 6 is an internal block diagram of a master of FIG. 3.

FIG. 6 is an internal block diagram of the mater shown in FIG. 3. The master may include a communication module 66 including a control unit 60, a memory unit 62, a key input unit 64, a master receiving unit 66Rx, and a master transmission unit 66Tx.

When requested from a user through the key input unit 64 for an on operation, an off operation, or a dimming operation with respect to all slaves or individual slave, the control unit 60 may construct a broadcast or unicast command data packet corresponding to the request, and output the command data packet to the communication module 66.

In addition, when requested from the user through the key input unit 64 for the state information such as the on state, the off state, and the breakdown state of the all slaves or individual slave or a state of a fan, the control unit 60 may construct a broadcast or unicast request data packet corresponding to the request, and output the request data packet to the communication module 66.

Therefore, the transmission unit 66Tx may transmit the data packet input from the control unit 60 to the slave by the broadcast scheme or the unicast scheme.

Next, the receiving unit 66Rx of the communication module 66 may receive a response data packet or an acknowledge data packet transmitted from the slave, and transmit the received data packet to the control unit 60.

Thus, when receiving the response data packet or the acknowledge data packet through the receiving unit 66Rx of the communication module 66, the control unit 60 may recognize completion or failure of operation and a dimming state according to the command data packet. Also, the control unit 60 may recognize breakdown of the LED array light source or the fan.

The state of the slave recognized by the control unit 60 may be stored in the memory unit 62 and displayed through a display unit (not shown) so that the user may properly cope with the state.

The key input unit 64 may include an on key, an off key, a dimming key to request the on or off operation or the dimming operation with respect to the all slaves or the individual slave. Additionally, the key input unit 64 may include a state request key to request the state of the all slaves or the individual slave.

The key input using 64 may further include a selection key to select a dimming level with respect to the individual slave.

The user may perform the on control, the off control, and the dimming control with respect to the all slaves or the individual slave using the on key, the off key, and the dimming key of the key input unit 64.

In addition, the user may request the state of the all slaves or the individual slave using the state request key of the key input unit 64, thereby recognizing the state of the all slaves or the individual slave.

Also, the user may select the dimming level with respect to the individual slave using the selection key. When the dimming level is selected by key operation through the key input unit 64, the control unit 60 may store the selected dimming level in the memory 62 and, upon request for the dimming operation, read a corresponding dimming level value from the memory unit 62 and transmit the dimming level value to a corresponding slave.

Figure 7:
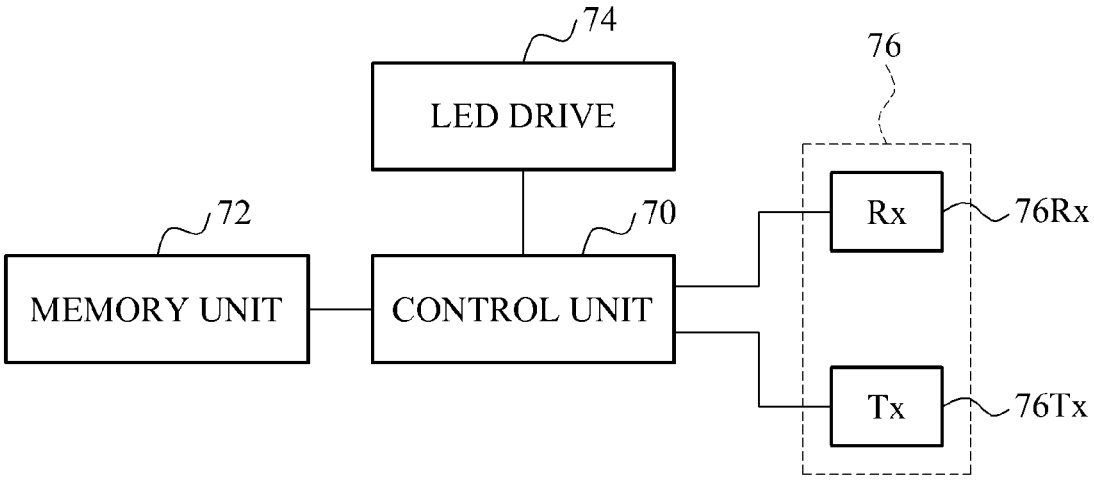
FIG. 7 is an internal block diagram of a slave of FIG. 3.

FIG. 7 is an internal block diagram of a slave of FIG. 3. The slave may include a communication module 76 including a control unit 70, a memory 72, an LED drive 74, a slave transmission unit 76Tx, and a slave receiving unit 76Rx.

When requested from the master through the receiving unit 76Rx of the communication module 76 for an on operation, an off operation, or a dimming operation, the control unit 70 may correspondingly output an on control signal, an off control signal, or a dimming control signal to the LED drive 74. Here, when transmitting the dimming control signal, the control unit 70 may also transmit a received dimming level.

Therefore, the LED drive 74 may perform the operation corresponding to the input control signal, and inform the control unit 70 of whether the operation is completed.

Thus, when the control unit 70 is notified of whether the operation is completed from the LED drive 74, the control unit 70 may generate a corresponding acknowledge data packet and transmit the acknowledge data packet to the master through the transmission unit 76Tx of the communication module 76. When requested from the master through the receiving unit 76Rx of the communication module 76 for state information such as an on state, an off state, a breakdown state, or a state of a fan, the control unit 70 may construct a response data packet corresponding to the request and transmit the response data packet to the master through the transmission unit 76Tx of the communication module 76.

For this purpose, the control unit 70 needs to be aware of the state of the LED array light source or the fan under the control of the control unit 70.

Figure 8:
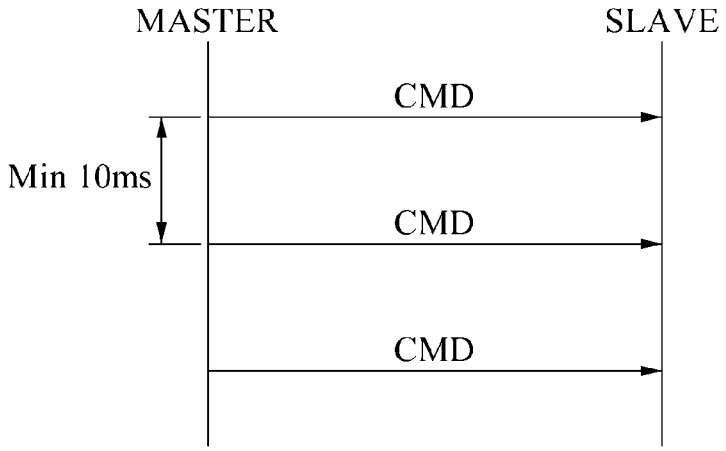
FIG. 8 is a signal flowchart illustrating a signal flow according to a broadcast scheme in a harbor lighting control apparatus according to an embodiment of the present invention.
Figure 9:
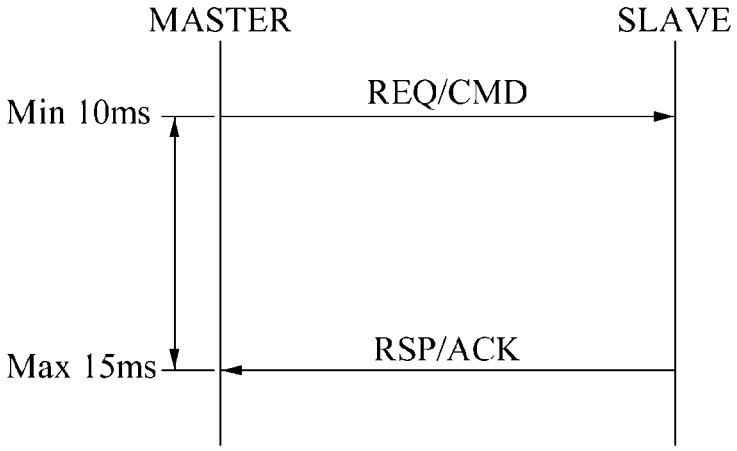
FIGS. 9 and 10 are signal flowcharts illustrating a signal flow according to a unicast scheme in a harbor lighting control apparatus according to an embodiment of the present invention.
Figure 10:
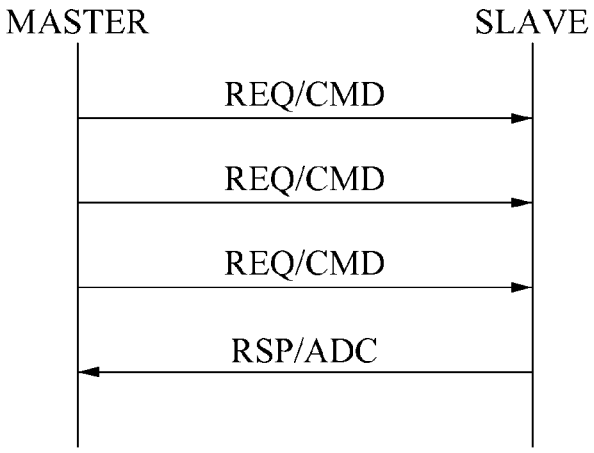

Data transmission between the master and the slave may be achieved by the broadcast scheme and the unicast scheme. FIGS. 8 to 10 show a signal flowchart related to the data transmission.

FIG. 8 illustrates a signal flow according to a broadcast scheme in a harbor lighting control apparatus according to an embodiment of the present invention. Referring to the drawing, when transmitting data packets by the broadcast scheme, the master may transmit the data packets at least three consecutive times at a predetermined constant time interval, for example, at least about 10 ms. Here, the reason for consecutive transmission is to prevent the slave from failing to receive the data packets.

FIG. 9 is a signal flowchart of when the master transmits data packets by the unicast scheme. As shown in the drawing, the master may transmit the data packets to a corresponding slave only once and check whether any response or acknowledge signal is received from the slave for at least about 10 ms to at most about 15 ms.

When any response or acknowledge signal is not received from the slave for at least about 10 ms to at most about 15 ms, the master may repeat the transmission and the check as shown in FIG. 10.

According to the example embodiments, since bi-directional communication is enabled, harbor lighting which requires a high output may be controlled stably and reliably.

According to the example embodiments, a breakdown state of an LED array light source may be quickly recognized by a master and therefore promptly handled.

Additionally, according to the example embodiments, a breakdown state of a fan provided to quickly remove generated heat may be efficiently recognized. Therefore, a fire by the heat may be prevented.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A harbor lighting control apparatus comprising:

a plurality of slaves each configured to perform at least one of on control, off control, and dimming control with respect to a light emitting diode (LED) array light source mounted to a lighthouse when at least one of an on control signal, an off control signal, and a dimming control signal are received, and to transmit a result of the control as acknowledge signals; and a master configured to transmit the at least one of the on control signal, the off control signal, and the dimming control signal to all of the plurality of slaves by a broadcast scheme, to transmit the at least one of the on control signal, the off control signal, and the dimming control signal to an individual slave by a unicast scheme, and to recognize operational states of the plurality of slaves by receiving the acknowledge signals from the plurality of slaves, wherein the at least one of the on control signal, the off control signal, and the dimming control signal transmitted by the master includes an identifier indicating whether the on control signal, the off control signal, or the dimming control signal is associated with the broadcast scheme or with the unicast scheme.

2. The harbor lighting control apparatus of claim 1, wherein each of the plurality of slaves comprises:

a slave receiver to receive the at least one of the on control signal, the off control signal, and the dimming control signal from the master;

a slave transmitter to transmit the acknowledge signals in relation to the at least one of the on control signal, the off control signal, and the dimming control signal to the master;

an LED drive to perform the at least one of on control, off control, and dimming control with respect to the LED array light source; and a controller to control the LED drive to perform the at least one of on control, off control, and dimming control with respect to the LED array light source when the at least one of the on control signal, the off control signal, and the dimming control signal are received from the master, and to transmit a result of the control as an acknowledge signal to the master through the slave transmitter.

3. The harbor lighting control apparatus of claim 1, wherein the master comprises:

a key input to receive an input of a command through key operation by a user;

a master transmitter to transmit the at least one of the on control signal, the off control signal, and the dimming control signal to all of the plurality of slaves by the broadcast scheme or the unicast scheme;

a master receiver to receive the acknowledge signals transmitted from the plurality of slaves; and a controller to transmit the at least one of the on control signal, the off control signal, and the dimming control signal by the broadcast scheme through the master transmitter when at least one of an on request signal, an off request signal, and a dimming request signal with respect to all of the plurality of slaves are input through the key input, to transmit at least one of the on control signal, the off control signal, and the dimming control signal through the master transmitter by the unicast scheme when the at least one of the on request signal, the off request signal, and the dimming request signal are related to the individual slave, and to recognize operational states of the plurality of slaves by receiving the acknowledge signals from the plurality of slaves through the master receiver.

4. The harbor lighting control apparatus of claim 1, wherein the master transmits state request signals to the plurality of slaves to request an on state, an off state, and a breakdown state of the LED array light source, and the plurality of slaves recognize a state of the LED light source and transmit the state as a response signal when the state request signals are received from the master.

5. The harbor lighting control apparatus of claim 1, wherein formats of the signals transmitted between the master and the plurality of slaves comprise a start field, a type field, an address field, a data field, a checksum field, and an end field.

6. The harbor lighting control apparatus of claim 5, wherein the address field includes the identifier indicating whether the signal is associated with the broadcast scheme or with the unicast scheme.

7. The harbor lighting control apparatus of claim 6, wherein the identifier is the most significant bit (MSB) of the address field.

8. The harbor lighting control apparatus of claim 6, wherein the address field further includes identifiers for individually identifying each of the plurality of slaves.

* * * * *